US007852292B2

(12) United States Patent
Jung et al.

(10) Patent No.: US 7,852,292 B2
(45) Date of Patent: Dec. 14, 2010

(54) PLASMA DISPLAY APPARATUS AND DRIVING METHOD THEREOF

(75) Inventors: Yun Kwon Jung, Gumi-si (KR); Moonshick Chung, Gumi-si (KR)

(73) Assignee: LG Electronics Inc., Seoul (KR)

( * ) Notice: Subject to any disclaimer, the term of this patent is extended or adjusted under 35 U.S.C. 154(b) by 898 days.

(21) Appl. No.: 11/348,230

(22) Filed: Feb. 7, 2006

(65) Prior Publication Data

US 2006/0181489 A1 Aug. 17, 2006

(30) Foreign Application Priority Data

Feb. 17, 2005 (KR) ..... 10-2005-0013326

(51) Int. Cl.
*G09G 3/28* (2006.01)

(52) U.S. Cl. ..... 345/63; 345/67

(58) Field of Classification Search ..... 345/160–172, 345/60–72; 315/169.3, 169.4
See application file for complete search history.

(56) References Cited

U.S. PATENT DOCUMENTS

2001/0019246 A1* 9/2001 Sakita et al. ..... 315/169.3
2003/0156082 A1 8/2003 Seo et al.
2003/0189534 A1* 10/2003 Myoung et al. ..... 345/67
2004/0012547 A1 1/2004 Lee
2004/0066355 A1* 4/2004 Shigeta et al. ..... 345/60
2004/0130508 A1 7/2004 Mizbata
2004/0233128 A1* 11/2004 Choi et al. ..... 345/60
2004/0239588 A1* 12/2004 Nagao et al. ..... 345/60
2004/0246205 A1 12/2004 Choi ..... 345/60
2005/0068262 A1* 3/2005 Mizobata et al. ..... 345/60

FOREIGN PATENT DOCUMENTS

JP 2001013910 1/2001
KR 10-2005-0036621 A 4/2005
KR 10-2005-0078455 A 8/2005

OTHER PUBLICATIONS

Chinese Office Action dated May 9, 2008.
European Search Report dated Jul. 2, 2009.

* cited by examiner

*Primary Examiner*—Amare Mengistu
*Assistant Examiner*—Insa Sadio
(74) *Attorney, Agent, or Firm*—Ked & Associates LLP

(57) ABSTRACT

The present invention relates to a plasma display apparatus. The plasma display apparatus according to the present invention comprises a plasma display panel comprising a scan electrode, a set-up driver that applies a rising pulse to the scan electrode during a reset period, a set-down driver that applies a first ramp-down pulse before the rising pulse is applied to the scan electrode and applies a second ramp-down pulse after the rising pulse is applied to the scan electrode, and a scan pulse driver that applies a scan pulse having an amount, which is substantially the same as that of the rising pulse, to the scan electrode during an address period subsequent to the reset period.

30 Claims, 9 Drawing Sheets

PLASMA DISPLAY APPARATUS AND DRIVING METHOD THEREOF

CROSS-REFERENCES TO RELATED APPLICATIONS

This Nonprovisional application claims priority under 35 U.S.C. §119(a) on Patent Application No. 10-2005-0013326 filed in Korea on Feb. 17, 2005 the entire contents of which are hereby incorporated by reference.

BACKGROUND OF THE INVENTION

1. Field of the Invention

The present invention relates to a display apparatus, and more particularly, to a plasma display apparatus.

2. Background of the Related Art

In general, a plasma display apparatus has a plasma display panel and a driver for driving the plasma display panel.

The plasma display panel has a front panel and a rear panel. A barrier rib formed between the front panel and the rear panel forms one unit cell. Each cell is filled with an inert gas containing a primary discharge gas, such as neon (Ne), helium (He) or a mixed gas of Ne+He, and a small amount of xenon (Xe). If the inert gas is discharged with a high frequency voltage, it generates vacuum ultraviolet rays. The vacuum ultraviolet rays excite phosphors formed between the barrier ribs, thereby implementing images.

FIG. 1 is a perspective view illustrating the construction of a general plasma display panel.

As shown in FIG. 1, the plasma display panel has a front panel 100 and a rear panel 110. In the front panel 100, a plurality of sustain electrode pairs in which scan electrodes 102 and sustain electrodes 103 are formed in pairs is arranged on a front glass 101 serving as a display surface on which images are displayed. In the rear panel 110, a plurality of address electrodes 113 crossing the plurality of sustain electrode pairs is arranged on a rear glass 111 serving as a rear surface. At this time, the front panel 100 and the rear panel 110 are parallel to each other with a predetermined distance therebetween.

The front panel 100 has the pairs of the scan electrodes 102 and the sustain electrodes 103, which mutually discharge the other and maintain the emission of a cell within one discharge cell. In other words, each of the scan electrode 102 and the sustain electrode 103 has a transparent electrode "a" formed of a transparent ITO material and a bus electrode "b" formed of a metal material. The scan electrodes 102 and the sustain electrodes 103 are covered with one or more dielectric layers 104 for limiting a discharge current and providing insulation among the electrode pairs. A protection layer 105 having Magnesium Oxide (MgO) deposited thereon is formed on the dielectric layers 104 so as to facilitate discharge conditions.

In the rear panel 110, barrier ribs 112 of stripe form (or well form), for forming a plurality of discharge spaces, i.e., discharge cells are arranged parallel to one another. Furthermore, a plurality of address electrodes 113, which generate vacuum ultraviolet rays by performing an address discharge, are disposed parallel to the barrier ribs 112. R, G and B phosphor layers 114 that radiate a visible ray for displaying images during an address discharge are coated on a top surface of the rear panel 110. A dielectric layer 115 for protecting the address electrodes 113 is formed between the address electrodes 113 and the phosphor layers 114.

A method of implementing gray levels of an image in the plasma display panel constructed above will be described below with reference to FIG. 2.

FIG. 2 is a view illustrating a method of implementing gray levels of an image of the plasma display panel in the related art.

As shown in FIG. 2, in the method of implementing gray levels of an image in the plasma display panel, one frame is divided into several sub-fields, each having a different number of emissions. Each of the sub-fields is again divided into a reset period (RPD) for initializing the entire cells, an address period (APD) for selecting a discharge cell to be discharged, and a sustain period (SPD) for implementing gray levels depending on a discharge number. For example, if it is sought to display images with 256 gray levels, a frame period (16.67 ms) corresponding to 1/60 seconds is divided into eight sub-fields (SF1 to SF8) as shown in FIG. 2. Each of the eight sub-fields (SF1 to SF8) is again divided into a reset period, an address period and a sustain period.

The reset period and the address period of each sub-field are the same every sub-field. Furthermore, an address discharge for selecting a discharge cell to be discharged is generated because of a voltage difference between the data electrodes and the scan electrodes, i.e., transparent electrodes. The sustain period is increased in the ratio of $2^n$ (where n=0, 1, 2, 3, 4, 5, 6, 7) in each sub-field. Since a sustain period is different in each sub-field as described above, gray levels of an image are represented by controlling a sustain period of each sub-field, i.e., a sustain discharge number.

FIG. 3 is a schematic circuit diagram of a scan driving apparatus for driving the related art plasma display panel.

As shown in FIG. 3, the scan driving apparatus of the related art plasma display panel bas an energy recovery circuit 40, a drive IC 52, a set-up supply unit 42, a set-down supply unit 47, a negative scan voltage supply unit 46, a scan reference voltage supply unit 50, a seventh switch Q7 connected between the set-up supply unit 42 and the drive IC 52, and a sixth switch Q6 connected between the set-up supply unit 42 and the energy recovery circuit 40.

The drive IC 52 is electrically connected to scan electrodes in a push/pull form, and applies a pulse of a driving waveform to the scan electrodes.

The energy recovery circuit 40 supplies the scan electrodes with a sustain voltage (Vs) and a sustain pulse (sus).

The negative scan voltage supply unit 46 sequentially supplies a write scan voltage (−Vy) for selecting a cell, which will be turned on, to the scan electrodes via the drive IC 52.

The scan reference voltage supply unit 50 supplies a voltage of a reference voltage source (Vsc) to the scan electrodes via the drive IC 52.

The set-up supply unit 42 receives the sum of the sustain voltage (Vs) output from the energy recovery circuit 40 and a voltage value of a set-up voltage source (Vsetup) and applies a ramp-up pulse (Ramp-up), which rises from the sustain voltage (Vs) with a predetermined gradient, to the scan electrodes via the drive IC 52.

The set-down supply unit 47 applies a ramp-down pulse (Ramp-down), which falls from the sustain voltage (Vs) output from the energy recovery circuit 40 with a predetermined gradient, to the scan electrodes via the drive IC 52.

FIG. 4 shows a driving waveform illustrating a method of driving the scan driving apparatus of the related art plasma display panel shown in FIG. 3.

A driving waveform generated by the scan driving apparatus of FIG. 4 will now be described with reference to FIG. 3. It is first assumed that a second capacitor C2 is charged with a voltage of the set-up voltage source (Vsetup) and the sustain voltage (Vs) is applied from the energy recovery circuit 40 to a first node n1 at a turned-on point of a fifth switch Q5.

During the set-up period (SU), the fifth switch Q5 and the seventh switch Q7 are turned on. At this time, the sustain voltage (Vs) is supplied from the energy recovery circuit 40. The sustain voltage (Vs) supplied from the energy recovery circuit 40 is supplied to scan electrode lines Y1 to Ym via an internal diode of the sixth switch Q6, the seventh switch Q7 and the drive IC 52. Therefore, voltages of the scan electrode lines Y1 to Ym abruptly rise to Vs.

Meanwhile, since the voltage (Vs) is supplied to a negative end of the second capacitor C2, the second capacitor C2 applies a voltage (Vs+Vsetup) to the fifth switch Q5. The fifth switch Q5 supplies a voltage, which is received from the second capacitor C2, to the first node n1 with a predetermined gradient while having its channel width controlled by a first variable resistor VR1 disposed at its front side. The voltage, which is supplied to the first node n1 with a predetermined gradient, is applied to the scan electrode lines Y1 to Ym via the seventh switch Q7 and the drive IC 52. At this time, the scan electrode lines Y1 to Ym are supplied with a ramp-up pulse (Ramp-up).

In this case, an amount of the set-up voltage source (Vsetup) is greater than the sum (Vsc+Vy) of the sustain voltage (Vs), an amount (Vsc) of the scan reference voltage source or an amount (Vy) of the write scan voltage source. Therefore, the highest voltage of the ramp-up pulse (Ramp-up) is twice greater than the sustain voltage (Vs) and luminance of a dark discharge becomes great. As a result, a problem arises because a contrast ratio is lowered.

After the ramp-up pulse (Ramp-up) is supplied to the scan electrode lines Y1 to Ym, the fifth switch Q5 is turned off. If the fifth switch Q5 is turned off, only the voltage (Vs) supplied from the energy recovery circuit 40 is applied to the first node n1. Accordingly, the voltages of the scan electrode lines Y1 to Ym abruptly fall to Vs.

Thereafter, in the set-down period (SD), while the seventh switch Q7 is turned off, a tenth switch Q10 is turned on. The tenth switch Q10 falls the voltage of the second node n2 to the write scan voltage (−Vy) with a predetermined gradient while having its channel width controlled by a second variable resistor VR2 disposed at its front side. At this time, the ramp-down pulse (Ramp-down) is supplied to the scan electrode lines Y1 to Ym.

The set-up supply unit 42 and the set-down supply unit 47 supply the ramp-up pulse (Ramp-up) and the ramp-down pulse (Ramp-down) to the scan electrode lines Y1 to Ym during the reset period, while repeating the above process.

In the related art driving apparatus, however, since a voltage difference between voltages applied to the first node n1 and the second node n2 is great, the seventh switch Q7 having a high withstanding voltage must be used. Therefore, a problem arises because the manufacturing cost is high.

The seventh switch Q7 has an internal diode in a direction different from that of the sixth switch Q6. The internal diode functions to prevent a voltage applied to the second node n2 from being supplied to a ground voltage (GND) via the internal diode of the sixth switch Q6 and the internal diode of the fourth switch Q4. Meanwhile, during the set-down period, the voltage (Vs) is applied to the first node n1, and the write scan voltage (−Vy) is applied to the second node n2. In this case, if the voltage (Vs) is set to approximately 180V and the write scan voltage (−Vy) is set to −70V, the seventh switch Q7 must have a withstanding voltage of about 250V (300V when considering actual driving voltage margin). That is, in the related art, a switching element having a high withstanding voltage must be disposed in the seventh switch Q7. Therefore, a problem arises because the manufacturing cost is high.

Furthermore, the reset voltage and the sustain voltage pass through the sixth switch Q6 and the seventh switch Q7. Therefore, the sixth switch Q6 and the seventh switch Q7 must be a switch that applies a set-up waveform and has a high withstanding voltage higher than the reset voltage. Therefore, there are problems in that the cost is high, heat is generated and energy lost is high.

SUMMARY OF THE INVENTION

Accordingly, an object of the present invention is to solve at least the problems and disadvantages of the background art.

It is an object of the present invention to provide a plasma display apparatus in which a switching element requiring high expenses can be obviated, thereby saving the manufacturing cost.

A plasma display apparatus according to an aspect of the present invention comprises a plasma display panel comprising a scan electrode, a set-up driver that applies a rising pulse to the scan electrode during a reset period, a set-down driver that applies a first ramp-down pulse before the rising pulse is applied to the scan electrode and applies a second ramp-down pulse after the rising pulse is applied to the scan electrode, and a scan pulse driver that applies a scan pulse having an amount, which is substantially the same as that of the rising pulse, to the scan electrode during an address period subsequent to the reset period.

A plasma display apparatus according to another aspect of the present invention comprises a plasma display panel comprising a scan electrode, a set-up driver that applies a rising pulse to the scan electrode in relation to a voltage supplied from a reference voltage source during a reset period, and a scan pulse driver that applies a scan pulse to the scan electrode in relation to the voltage supplied from the reference voltage source during an address period subsequent to the reset period.

The present invention is advantageous in that it can save the manufacturing cost and can also improve a contrast characteristic when a plasma display panel is driven.

BRIEF DESCRIPTION OF THE DRAWINGS

The invention will be described in detail with reference to the following drawings in which like numerals refer to like elements.

DETAILED DESCRIPTION OF THE PREFERRED EMBODIMENT

Figure 1:
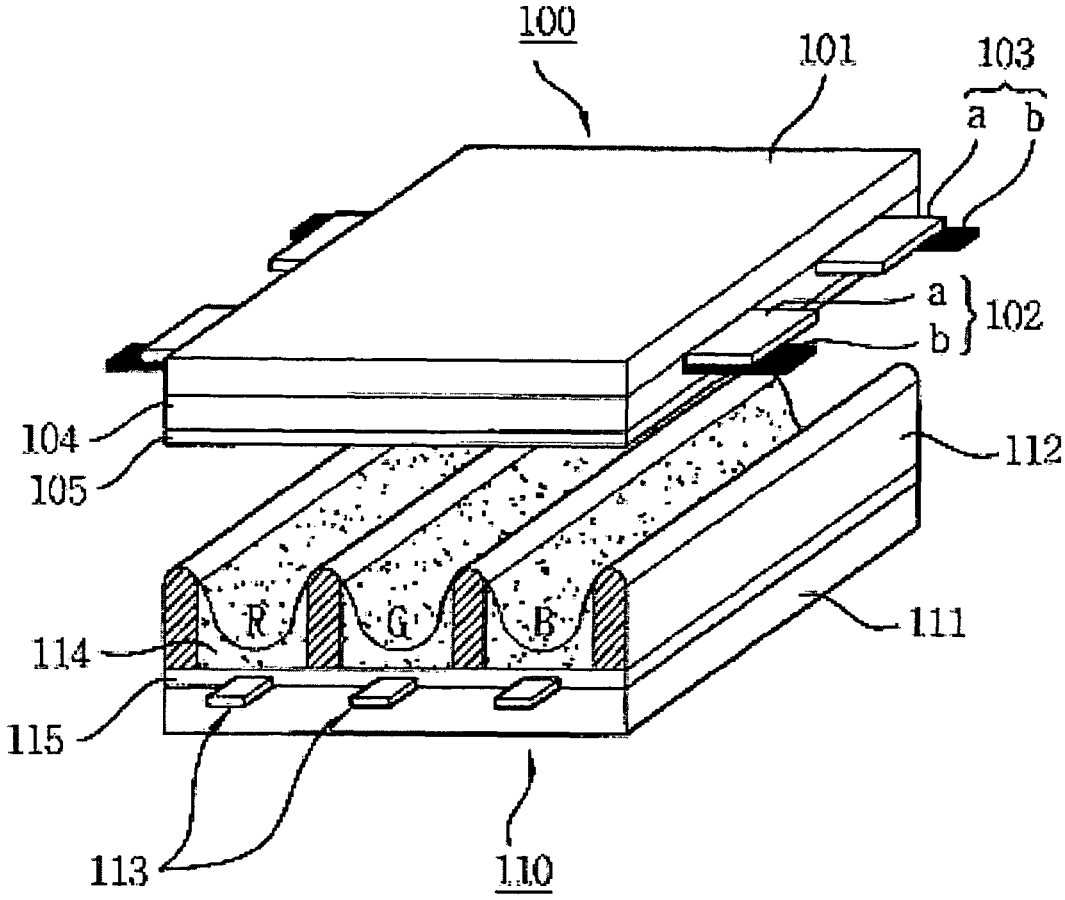
Fig. 1 Related Art
FIG. 1 is a perspective view illustrating the construction of a general plasma display panel.
Figure 2:
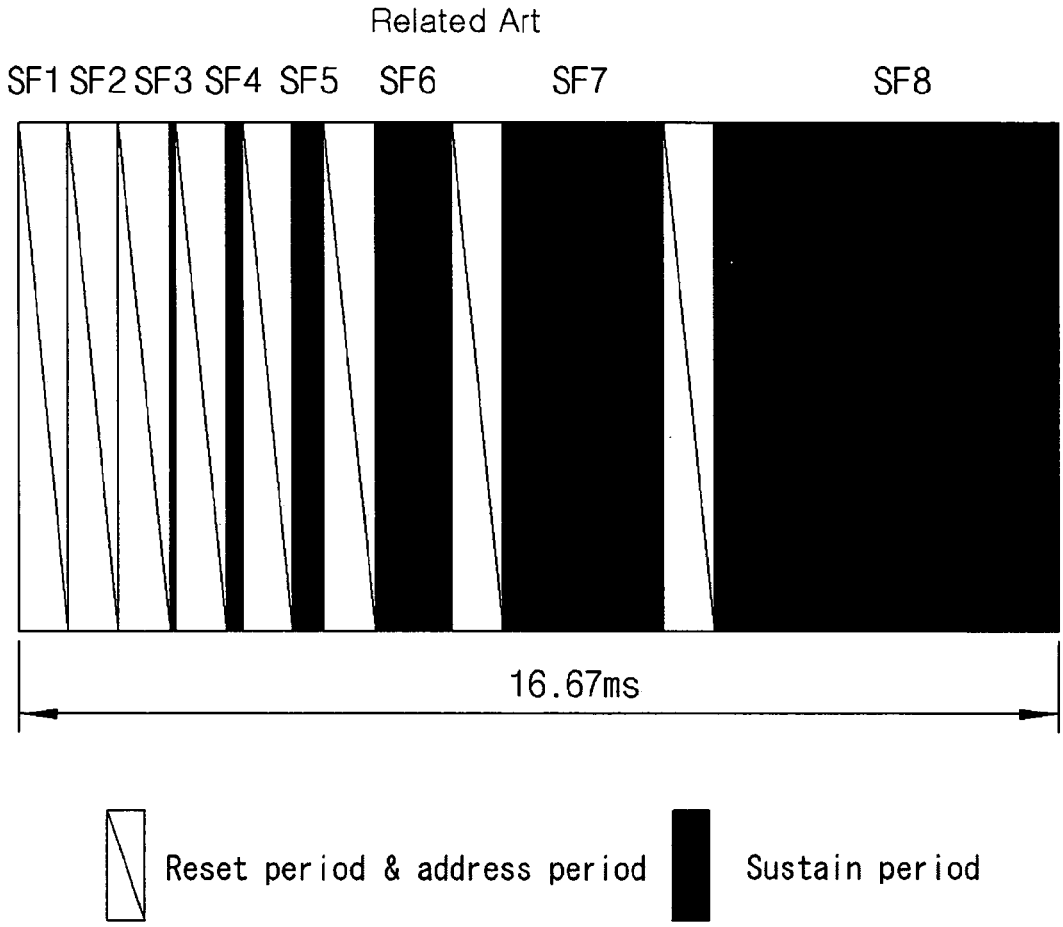
FIG. 2 is a view illustrating a method of implementing gray levels of an image of a plasma display panel in the related art.

Preferred embodiments of the present invention will be described in a more detailed manner with reference to the drawings.

A plasma display apparatus according to an aspect of the present invention comprises a plasma display panel comprising a scan electrode, a set-up driver that applies a rising pulse to the scan electrode during a reset period, a set-down driver that applies a first ramp-down pulse before the rising pulse is applied to the scan electrode and applies a second ramp-down pulse after the rising pulse is applied to the scan electrode, and a scan pulse driver that applies a scan pulse having an amount, which is substantially the same as that of the rising pulse, to the scan electrode during an address period subsequent to the reset period.

A reference voltage from which the first ramp-down pulse begins is substantially the same as a reference voltage from which the second ramp-down pulse begins.

A reference voltage from which the first ramp-down pulse begins is substantially the same as a voltage of a sustain pulse applied to the scan electrode during a sustain period.

A gradient of the first ramp-down pulse is substantially the same as that of the second ramp-down pulse.

A voltage value of the rising pulse gradually rises near a voltage of a sustain pulse applied to the scan electrode during a sustain period.

A voltage value of the second ramp-down pulse gradually falls near a voltage of a sustain pulse applied to the scan electrode during a sustain period.

A voltage difference between a voltage value of a start point of the rising pulse and a voltage value of an end point of the rising pulse is less than a voltage value of the scan pulse.

A voltage difference between a voltage value of a start point of the rising pulse and a voltage value of an end point of the rising pulse equals 10V or less.

A voltage value of an end point of the second ramp-down pulse is substantially the same as a voltage value of the scan pulse.

A plasma display apparatus according to another aspect of the present invention comprises a plasma display panel comprising a scan electrode, a set-up driver that applies a rising pulse to the scan electrode in relation to a voltage supplied from a reference voltage source during a reset period, and a scan pulse driver that applies a scan pulse to the scan electrode in relation to the voltage supplied from the reference voltage source during an address period subsequent to the reset period.

The rising pulse rises, with a gradient, from near a voltage of a sustain pulse applied to the scan electrode during a sustain period.

A voltage difference between a voltage value of a start point of the rising pulse and a voltage value of an end point of the rising pulse equals 100V or less.

The scan electrode is applied with a first ramp-down pulse before the rising pulse is applied, and is applied with a second ramp-down pulse after the rising pulse is applied.

A gradient of the first ramp-down pulse is substantially the same as that of the second ramp-down pulse.

A reference voltage from which the first ramp-down pulse begins is substantially the same as a voltage of a sustain pulse applied to the scan electrode during a sustain period.

A reference voltage from which the first ramp-down pulse begins is substantially the same as a reference voltage from which the second ramp-down pulse begins.

The lowest voltage value of the second ramp-down pulse is substantially the same as a voltage value of an end point of the scan pulse applied to the scan electrode during the address period.

An apparatus for driving a plasma display panel according to further another aspect of the present invention comprises a sustain pulse reference voltage node, an energy recovery circuit connected to the sustain pulse reference voltage node, a blocking switch connected at one end to an output terminal of the energy recovery circuit, a scan pulse and set-up pulse reference voltage node, a set-up capacitor connected between the scan pulse and set-up pulse reference voltage node and the other end of the blocking switch, and first and second set-up switches connected in series between the scan pulse and set-up pulse reference voltage node and the other end of the blocking switch.

A plasma display apparatus and driving method thereof according to the present invention will now be described with reference to the accompanying drawings.

Figure 5:
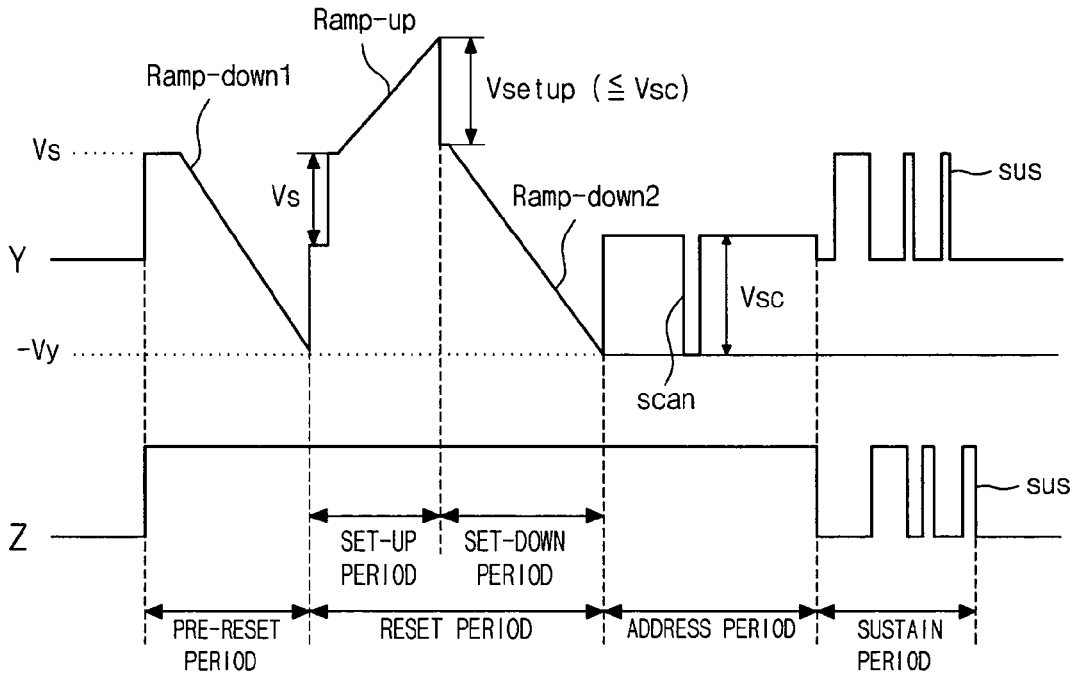
FIG. 5 shows a driving waveform illustrating a method of driving a plasma display panel according to the present invention.

FIG. 5 shows a driving waveform illustrating a method of driving a plasma display panel according to the present invention.

As shown in FIG. 5, the driving method of the present invention is performed with one sub-field being divided into a pre-reset period, a reset period, an address period and a sustain period.

In the pre-reset period, the entire scan electrode lines are supplied with a first ramp-down pulse (Ramp-down1) that falls from a first voltage to a predetermined voltage with a first gradient. At this time, the first voltage is a reference voltage at which the first ramp-down pulse (Ramp-down1) begins and is a voltage (Vs) of a sustain pulse applied to a scan electrode or a sustain electrode during the sustain period.

The first ramp-down pulse (Ramp-down1) supplied to the scan electrode during the pre-reset period partially erases wall charges that are irregularly accumulated on cells of the plasma display panel prior to the pre-reset period, making regular the wall charges.

In the reset period, the entire scan electrode lines are supplied with a rising pulse (Ramp-up), which abruptly rises from a predetermined voltage to a voltage of the sustain pulse and then falls up to a second voltage with a second gradient, and are also supplied with a second ramp-down pulse (Ramp-down2), which abruptly falls up to the first voltage and then falls with a third gradient. At this time, a voltage difference between the lowest voltage value and the highest voltage value of the rising pulse can be the same as or less than a voltage (Vsc) of the scan pulse supplied to the scan electrode during the address period. The voltage difference between the lowest voltage value and the highest voltage value of the rising pulse can be preferably 100V or less. Furthermore, a magnitude of the third gradient of the second ramp-down pulse can be the same as or different from that of the first gradient.

The rising pulse (Ramp-up) supplied to the entire scan electrode lines during the reset period generates a dark discharge within cells formed in the entire screen of the plasma display panel. In this case, positive wall charges are accumulated on the address electrode and the sustain electrode and negative wall charges are accumulated on the scan electrode. The second ramp-down pulse (Ramp-down2) is then supplied to erase some of wall charges that are excessively formed within cells.

At this time, the highest voltage of the rising pulse (Ramp-up) is lower than that of the rising pulse in the related art driving method. Therefore, since luminance due to a dark discharge is small, a contrast characteristic can be improved.

In the address period, while scan pulses (scan) are sequentially applied to the scan electrode lines, a data pulse (not shown) is supplied to the address electrode in synchronization with the scan pulse (scan), thus selecting a cell to be turned on. At this time, the lowest voltage of the scan pulse is substantially the same as the lowest voltage of the second ramp-down pulse.

In the sustain period, a sustain pulse (sus) is alternately applied to the scan electrode and the sustain electrode, thus generating a sustain discharge.

Figure 6:
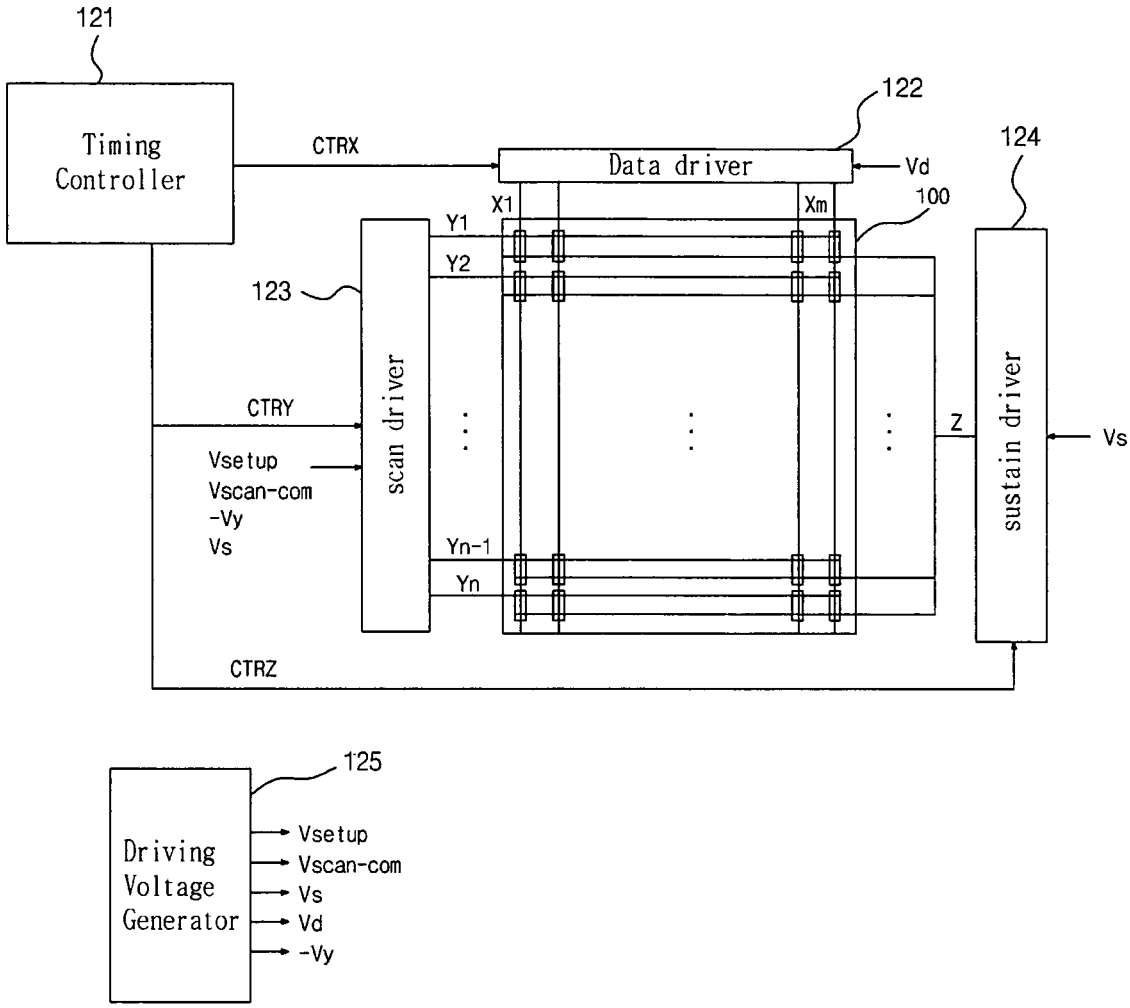
FIG. 6 is a block diagram schematically showing a plasma display apparatus according to the present invention.

FIG. 6 is a block diagram schematically showing a plasma display apparatus according to the present invention.

Referring to FIG. 6, the plasma display apparatus of the present invention comprises a plasma display panel 100 on which images are displayed, a data driver 122 for supplying data to address electrodes X1 to Xm formed on the plasma display panel 100, a scan driver 123 for driving scan electrodes Y1 to Yn, a sustain driver 124 for driving a sustain electrode Z (i.e., a common electrode), a timing controller 121 for controlling the data driver 122, the scan driver 123 and the sustain driver 124 when the plasma display panel 100 is driven, and a driving voltage generator 125 for supplying driving voltages necessary for the drivers 122, 123 and 124 thereto.

The plasma display panel 100 has a front panel (not shown) and a rear panel (not shown), which are coalesced with a predetermined distance therebetween. A number of electrodes, such as the scan electrodes Y1 to Yn and the sustain electrode Z, is formed in pairs in the front panel. The address electrodes X1 to Xm are formed in the rear panel in such a way to cross the scan electrodes Y1 to Yn and the sustain electrode Z.

The data driver 122 is supplied with data, which have experienced inverse gamma correction, error diffusion and so on through an inverse gamma correction circuit (not shown), an error diffusion circuit (not shown) and so on and are then mapped to respective sub-fields by a sub-field mapping circuit. The data driver 122 samples and latches data in response to a timing control signal (CTRX) output from the timing controller 121 and supplies the data to the address electrodes X1 to Xm.

The scan driver 123 supplies the first ramp-down waveform (Ramp-down1) to the scan electrode Y1 to Yn during the pre-reset period and supplies the rising waveform (Ramp-up) and the second ramp-down waveform (Ramp-down2) to the scan electrode Y1 to Yn during the reset period, under the control of the timing controller 121. Furthermore, the scan driver 123 sequentially supplies the scan pulses (Sp) of a scan voltage (−Vy) to the scan electrodes Y1 to Yn during the address period and also supplies the sustain pulse (sus) to the scan electrodes Y1 to Yn during the sustain period, under the control of the timing controller 121.

The sustain driver 124 supplies a bias voltage of the sustain voltage (Vs) to the sustain electrode Z from the pre-reset period to the address period under the control of the timing controller 121, and alternately operates with the scan driver 123 during the sustain period, thus supplying the sustain pulse (sus) to the sustain electrode Z.

The timing controller 121 receives vertical/horizontal sync signals and a clock signal, generates timing control signals (CTRX, CTRY and CTRZ) for controlling an operating timing and synchronization of the respective drivers 122, 123 and 124 in the reset period, the address period and the sustain period. The timing controller 121 provides the generated timing control signals (CTRX, CTRY, CTRZ) to corresponding drivers 122, 123 and 124, thus controlling the respective drivers 122, 123 and 124.

Meanwhile, the data control signal (CTRX) includes a sampling clock for sampling data, a latch control signal, and a switching control signal for controlling an on/off time of an energy recovery circuit and a driving switch element. The scan control signal (CTRY) comprises a switching control signal for controlling an on/off time of an energy recovery circuit and a driving switch element within the scan driver 123. The sustain control signal (CTRZ) comprises a switching control signal for controlling an on/off time of an energy recovery circuit and a driving switch element within the sustain driver 124.

The driving voltage generator 125 generates a set-up voltage (Vsetup), a common scan voltage (Vscan-com), a scan voltage (−Vy), a sustain voltage (Vs), a data voltage (Vd) and the like. The driving voltages may be varied depending on the composition of a discharge gas, the structure of a discharge cell and/or the like.

Figure 7:
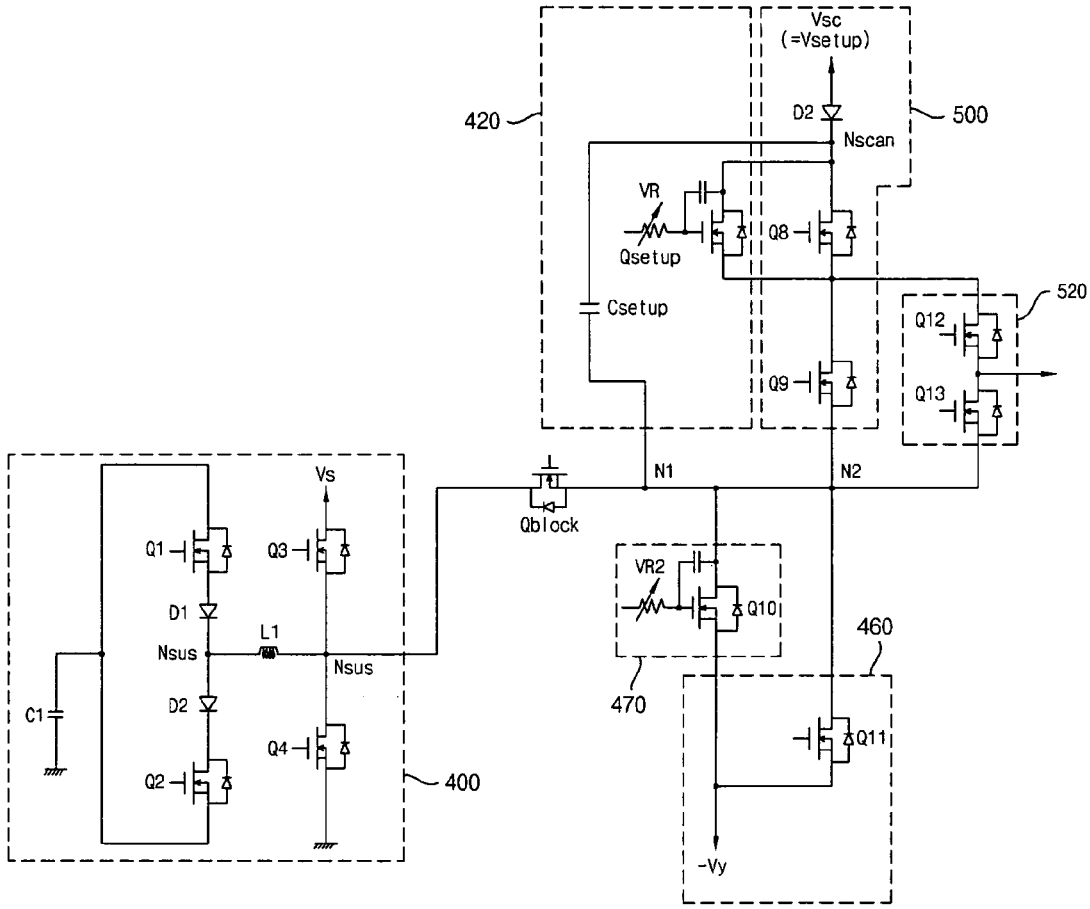
FIG. 7 is a detailed circuit diagram of a scan driver of the plasma display apparatus according to the present invention.

FIG. 7 is a detailed circuit diagram of a scan driver of the plasma display apparatus according to the present invention.

Referring to FIG. 7, the scan driver of the plasma display apparatus according to the present invention comprises an energy recovery circuit 400, a drive IC 520, a set-up supply unit 420, a set-down supply unit 470, a negative scan voltage supply unit 460, a scan reference voltage supply unit 500 and a blocking switch Qblock.

The drive IC 520 is connected to the scan electrode Y in a push/pull form. The driver IC 520 has twelfth and thirteenth switches Q12, Q13 to which voltage signals are input from the energy recovery circuit 400, the set-up supply unit 420, the set-down supply unit 470, the negative scan voltage supply unit 460 and the scan reference voltage supply unit 500. An output line between the twelfth and thirteenth switches Q12, Q13 is connected to any one of the scan electrode lines.

The energy recovery circuit 400 comprises an external capacitor C1 connected to a sustain reference voltage node Nsus, for charging energy recovered from the panel Cp therein, an inductor L1 connected between the external capacitor C1 and the drive IC 520, and a first switch Q1, a first diode D1, a second switch Q2 and a second diode D2 which are connected in series between the inductor L1 and the external capacitor C1.

The operation of the energy recovery circuit 400 will now be described. It is first assumed that the external capacitor C1 is charged with a voltage (Vs/2). If the first switch Q1 is turned on, the voltage charged into the external capacitor C1 is supplied to the drive IC 520 via the first switch Q1, the first diode D1, the inductor L, and an internal diode of the blocking switch Qblock.

The drive IC 520 supplies the received voltage to the scan electrode lines Y1 to Ym. At this time, the inductor L1 constitutes a serial LC resonance circuit together with the capacitor (C) of a discharge cell of the plasma display panel. Therefore, the scan electrode lines Y1 to Ym are supplied with the voltage (Vs).

The third switch Q3 is then turned on. If the third switch Q3 is turned on, the sustain voltage (Vs) is supplied to the drive IC 520 via the internal diode of the blocking switch Qblock. The drive IC 520 supplies the received sustain voltage to the scan electrode lines Y1 to Ym. The sustain voltage (Vs) causes a voltage level on the scan electrode lines Y1 to Ym to maintain the sustain voltage (Vs), so that a sustain discharge is generated in the discharge cells.

After the sustain discharge is generated in the discharge cells, the second switch Q2 is turned on. If the second switch Q2 is turned on, reactive power is recovered by the external capacitor C1 via the scan electrode lines Y1 to Ym, the drive IC 520, the internal diode of the blocking switch Qblock, the inductor L1, the second diode D2 and the second switch Q2. That is, the energy is recovered from the plasma display panel to the external capacitor C1. The fourth switch Q4 is then turned on, and a voltage on the scan electrode lines Y1 to Ym is kept to the ground voltage (GND).

In the energy recovery circuit 400, as described above, after energy is recovered from the plasma display panel, a voltage is applied to the scan electrode lines Y1 to Ym using the recovered energy. Therefore, excessive power consumption when the set-up period and the sustain period are discharge can be reduced.

The negative scan voltage supply unit 460 has an eleventh switch Q11 connected between the second node N2 and the write scan voltage source (−Vy). The eleventh switch Q11 is switched according to a control signal supplied from a timing controller (not shown) during the address period and thus supplies the write scan voltage (−Vy) to the drive IC 520.

The scan reference voltage supply unit 500 comprises a third capacitor C3 connected between a reference voltage source (Vsc) and a second node N2, and an eighth switch Q8 and a ninth switch Q9 connected between the reference voltage source (Vsc) and the third node N3. The eighth switch Q8 and the ninth switch Q9 are switched according to a control signal output from the timing controller (not shown) and thus supply a voltage of the reference voltage source (Vsc) to the drive IC 520.

In the present invention, the negative scan voltage supply unit 460 and the scan reference voltage supply unit 500 that supply the scan pulse to the scan electrode Y in the address period are also called a scan pulse driver.

The set-down supply unit 470 applies the first ramp-down pulse (Ramp-down1), which falls with a predetermined gradient from the sustain voltage (Vs) supplied from the energy recovery circuit 400, and the second ramp-down pulse (Ramp-down2), which falls with a predetermined gradient from the sustain voltage (Vs) after the rising pulse (Ramp-up) is supplied from the set-up supply unit 420, to the scan electrode Y via the drive IC 520.

That is, the set-down supply unit 470 comprises a tenth switch Q10 connected between the first node N1 and the write scan voltage (−Vy). The set-down supply unit 470 gradually falls a voltage, which has been supplied to the drive IC 520 during the set-down period included in the reset period, up to the write scan voltage (−Vy) with a gradient.

The set-up supply unit 420 comprises a set-up capacitor Csetup connected between a scan pulse and set-up pulse reference voltage node Nscan and the other end of the blocking switch Qblock. The set-up supply unit 420 receives the sum of the sustain voltage (Vs) supplied from the energy recovery circuit 400 and a voltage value of the set-up voltage source (Vsetup), and applies a rising pulse (Ramp-up), which raises from the sustain voltage (Vs) with a predetermined gradient, to the scan electrode Y via the drive IC 520.

The blocking switch Qblock is connected to the output terminal of the energy recovery circuit 400, and shuts between-the energy recovery circuit 400 and the set-down supply unit 470 when the negative scan voltage supply unit 460 applies the write scan voltage (−Vy).

In the scan driver of the plasma display apparatus according to the present invention, the set-up supply unit 420 and the scan reference voltage supply unit 500 can share the voltage source (Vsetup=Vsc) that is substantially the same, or the voltage source (Vsetup) of the set-up supply unit 420 can be higher than the voltage source (Vsc) of the scan reference voltage supply unit 500.

The set-up capacitor Csetup receives the sustain voltage (Vs) from the energy recovery circuit 400 via the blocking switch Qblock and supplies the sum (Vs+Vsetup) of the sustain voltage (Vs) and a voltage of the set-up voltage source (Vsetup) to the scan electrode Y through the drive IC 520. One end of the set-up capacitor Csetup is connected to the set-up voltage source (Vsetup) and the other end of the set-up capacitor Csetup is connected to the other end of the drive IC 520.

The set-up switch Qsetup is turned on to supply the rising pulse (Ramp-up), which rises from the sustain voltage (Vs) supplied from the set-up capacitor Csetup up to a voltage of the set-up voltage source (Vsetup) with a predetermined gradient, to the scan electrode Y via the drive IC 520. One end of the set-up switch Qsetup is connected to a common end of the set-up capacitor Csetup and the set-up voltage source (Vsetup), and the other end of the set-up switch Qsetup is connected to one end of the drive IC 520.

As described above, the set-up supply unit 420 included in the scan driver of the present invention does not apply the rising pulse (Ramp-up) to the scan electrode Y via the sixth switch Q6 and the seventh switch Q7 included in the scan driver of the plasma display apparatus as in the related art, but directly applies the rising pulse (Ramp-up) to the drive IC 520.

The set-up supply unit 420 and the scan reference voltage supply unit 500 can share one power supply source (Vsetup=Vsc) Therefore, the highest voltage of the rising pulse (Ramp-up) is lower than the highest voltage of the rising pulse supplied by the set-up supply unit 42 in the related art.

Therefore, the rising pulse (Ramp-up) can be applied to the scan electrode Y through the twelfth switch Q12 and the thirteenth switch Q13 of the drive IC 520 having a low withstanding voltage.

Accordingly, the sixth switch Q6, i.e., a high voltage withstanding switch, which is used in the related art scan driver in order to apply the set-up waveform, is unnecessary. Therefore, the construction of a circuit can be simplified and the manufacturing cost can be saved.

The operation of the scan driver included in the plasma display apparatus of the present invention will now be described.

If the third switch Q3 of the energy recovery circuit 400, the blocking switch Qblock and the thirteenth switch Q13 of the drive IC 520 are turned on, the sustain voltage (Vs) is applied to the scan electrode Y. Thereafter, if the blocking switch Qblock is turned off and the tenth switch Q10 of the set-down supply unit 470 is turned on, the first ramp-down pulse (Ramp-down1) is applied to the scan electrode Y. At this time, the blocking switch Qblock shuts between-the energy recovery circuit 400 and the set-down supply unit 470.

Thereafter, if the tenth switch Q10 of the set-down supply unit 470 is turned off, and the third switch Q3 of the energy recovery circuit 400, the blocking switch Qblock and the thirteenth switch Q13 of the drive IC 520 are turned on, the sustain voltage (Vs) is applied to the scan electrode Y. Thereafter, if the set-up switch Qsetup of the set-up supply unit 420 and the twelfth switch Q12 of the drive IC 520 are turned on, the rising pulse (Ramp-up) that rises from the sustain voltage (Vs) with a predetermined gradient is applied to the scan electrode Y.

Thereafter, if the set-up switch Qsetup of the set-up supply unit 420 and the twelfth switch Q12 of the drive IC 520 are turned off, a voltage level of the scan electrode abruptly rises up to the sustain voltage (Vs). Thereafter, if the tenth switch Q10 of the set-down supply unit 470 and the thirteenth switch Q13 of the drive IC 520 are turned on, the second ramp-down pulse (Ramp-down2) that falls from the sustain voltage (Vs) with a predetermined gradient is applied to the scan electrode Y.

If the scan driver of the plasma display apparatus according to the present invention is constructed as shown in FIG. 7, the number of switching elements can be reduced and the manufacturing cost can be saved accordingly. It is also possible to improve a contrast characteristic.

Figure 8:
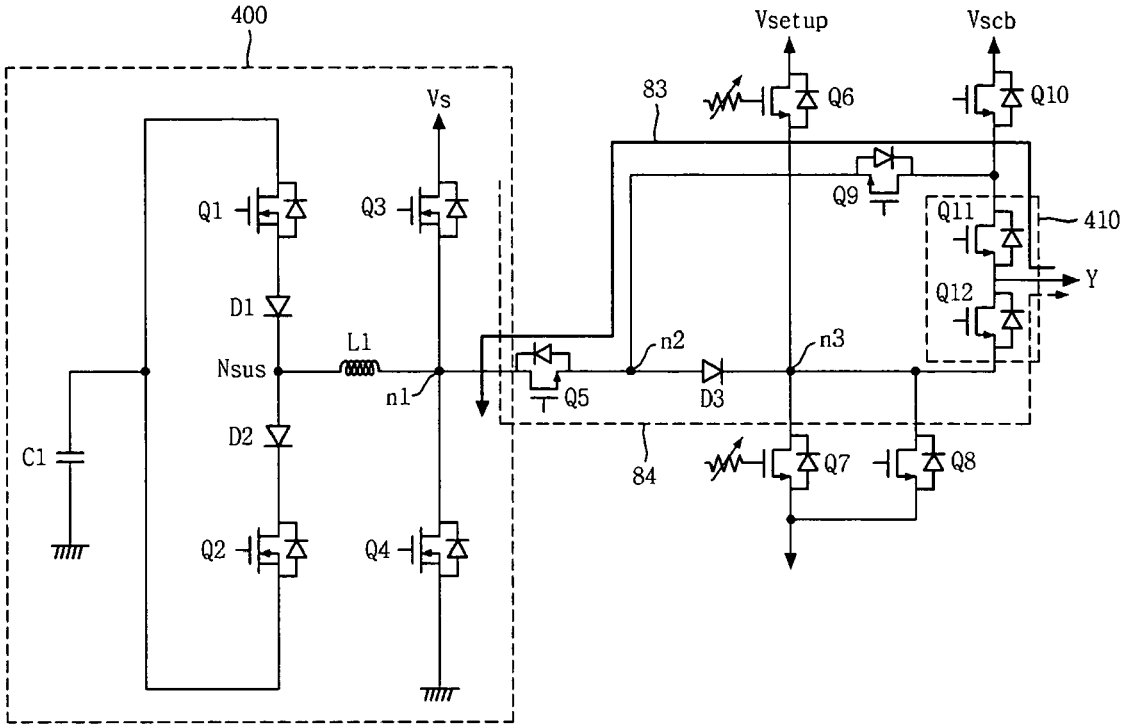
FIG. 8 is a view illustrating a scan driver having a different structure from that of a plasma display apparatus according to the present invention.
Figure 9:
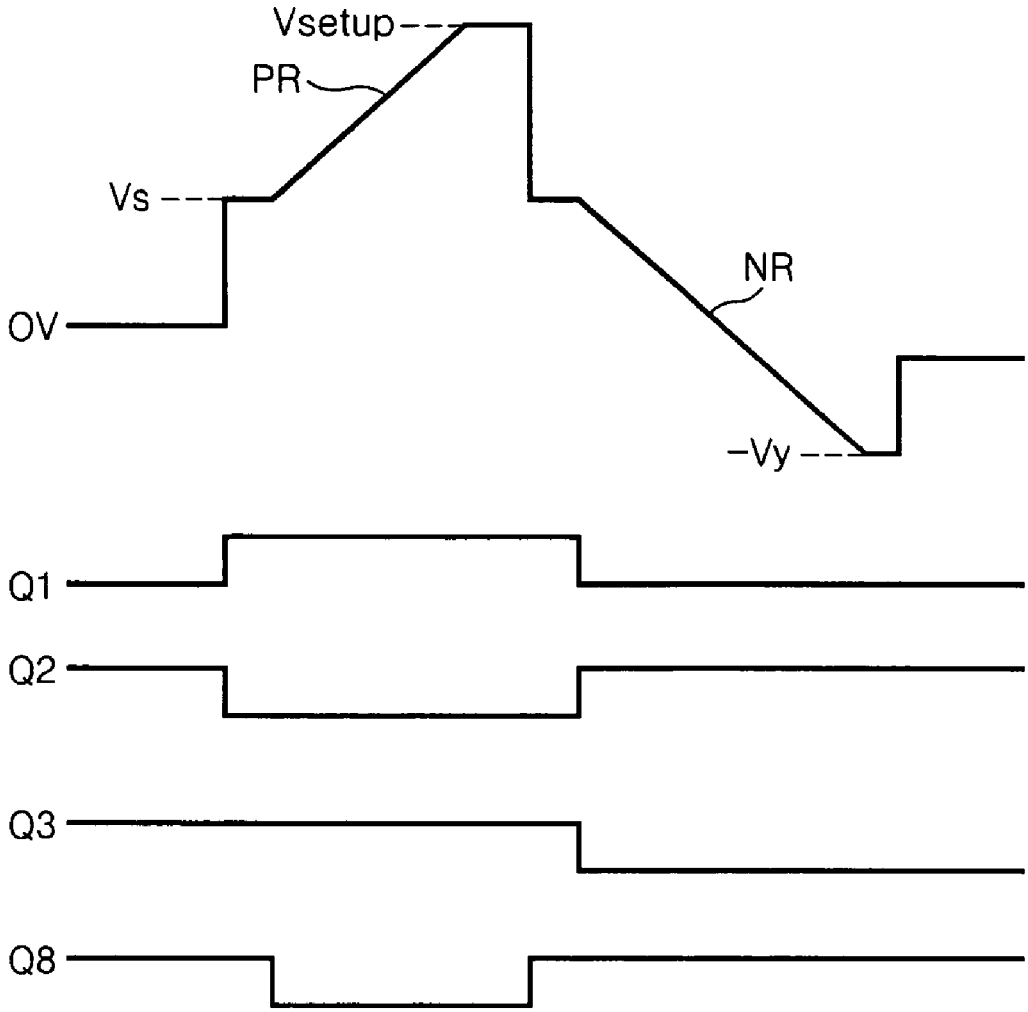
FIG. 9 is an operational timing diagram of switch elements that are driven during the reset period by the scan driver of FIG. 8.

FIG. 8 is a view illustrating a scan driver having a different structure from that of a plasma display apparatus according to the present invention. FIG. 9 is an operational timing diagram of switch elements that are driven during the reset period by the scan driver of FIG. 8.

Referring to FIGS. 8 and 9, the scan driver of the plasma display apparatus according to the present invention comprises an energy recovery circuit 400, a diode D1, first to tenth switch elements Q1 to Q10, and a driving switch circuit 410. The switch elements included in the scan driver are Field Effect Transistors (FETs) which have built body diodes therein and allow for high-voltage switching.

The energy recovery circuit 400 recovers energy of reactive power, which does not contribute to a discharge in a plasma display panel, from a scan electrode Y and charges the scan electrode Y using the recovered energy. The energy recovery circuit 400 can be implemented using any know energy recovery circuit.

The driving switch circuit 410 comprises eleventh and twelfth switch elements Q11, Q12 that are connected between a third node n3 and a fourth node n4 in push-pull form. An output terminal between the eleventh and twelfth switch elements Q11, Q12 is connected to the scan electrode Y.

A source terminal and the anode terminal of the body diode, of the eleventh switch element Q11, are connected to the scan electrode Y. A drain terminal and the cathode terminal of the body diode, of the eleventh switch element Q11, are connected to the fourth node n4. The eleventh switch element Q11 supplies a voltage, which is output from the scan electrode Y, to the fourth node n4 through its body diode when it is necessary to lower a voltage of the scan electrode Y to a ground voltage (GND) or a negative scan voltage (−Vy), such as from a sustain voltage (Vs) to a ground voltage (GND), when a voltage shifts from the sustain voltage (Vs) or a scan bias voltage (Vscb) to a scan voltage (−Vy).

A source terminal and the anode terminal of the body diode, of the twelfth switch element Q12, are connected to the third node n3. A drain terminal and the cathode terminal of the body diode, of the twelfth switch element Q11, are connected to the scan electrode Y. The twelfth switch element Q12 supplies a voltage, which is output from the third node n3, to the scan electrode Y through its body diode when it is necessary to raise a voltage of the scan electrode Y, such as from the scan voltage (−Vy) to the scan bias voltage (Vscb) and from the sustain voltage (Vs) to the set-up voltage (Vsetup) when a voltage shifts from the ground voltage (GND) to the sustain voltage (Vs).

A source terminal and the anode terminal of the body diode, of the third switch element Q3, are connected to the first node n1. A drain terminal and the cathode terminal of the body diode, of the third switch element Q3, are connected to the sustain voltage source (Vs). The third switch element Q3 is turned on when it is necessary to sustain a voltage of the scan electrode Y to the sustain voltage (Vs) in response to a control signal input to its gate terminal, thus supplying the sustain voltage (Vs) to the first node n1.

A source terminal and the anode terminal of the body diode, of the fourth switch element Q4, are connected to the ground voltage source (GND). A drain terminal and an cathode terminal of the body diode, of the fourth switch element Q4, are connected to the first node n1. The fourth switch element Q4 is turned on when it is necessary to maintain a voltage of the scan electrode Y to the ground voltage (GND) or 0V during the set-up period (SU), the address period (AD) and the sustain period (SP) in response to a control signal input to its gate terminal, thereby supplying the ground voltage (GND) to the first node n1.

A source terminal and the anode terminal of the body diode, of the fifth switch element Q5, are connected to the second node n2. A drain terminal and the cathode terminal of the body diode, of the fifth switch element Q5, are connected to the first node n1. The fifth switch element Q5 is turned on when it is necessary to raise a voltage of the scan electrode Y up to the set-up voltage (Vsetup) during the set-up period (SU) or to maintain a voltage of the scan electrode Y to the sustain voltage (Vs) during the sustain period (SP) in response to a control signal input to its gate terminal, thus supplying a voltage of the first node n1 to the second node n2. Furthermore, the fifth switch element Q5 supplies a voltage of the second node n2 to the fourth switch element Q4, through its a body diode, in an off state via the first node n1 when a voltage of the scan electrode Y falls from the sustain voltage (Vs) to the ground voltage (GND) or 0V.

A variable resistor and a capacitor are connected between a gate terminal and a source terminal of the sixth switch element Q6. Furthermore, the source terminal and the anode terminal of the body diode, of the sixth switch element Q6, are connected to a set-up voltage source (Vsetup). A drain terminal and the cathode terminal of the body diode, of the sixth switch element Q6, are connected to the third node n3. The sixth switch element Q6 is turned on during the set-up period (SU) in response to a control signal input to its gate terminal when a voltage of the scan electrode Y is raised up to the set-up voltage (Vsetup) using a positive ramp waveform (PR), thus supplying the set-up voltage (Vsetup) to the third node n3.

A variable resistor and a capacitor are connected between a gate terminal and a source terminal of the seventh switch element Q7. Furthermore, the source terminal and the anode terminal of the body diode, of the seventh switch element Q7, are connected to the negative scan voltage source (−Vy). A drain terminal and the cathode terminal of the body diode, of the seventh switch element Q7, are connected to the third node n3. The seventh switch element Q7 is turned on during the set-down period (SD) in response to a control signal input to its gate terminal when a voltage of the scan electrode Y falls to the negative scan voltage (−Vy) using the negative ramp waveform (NR), thus lowering the voltage of the third node n3 to the negative scan voltage (−Vy).

A source terminal and the anode terminal of the body diode, of the eighth switch element Q8, are connected to the negative scan voltage source (−Vy). A drain terminal and the cathode terminal of the body diode, of the eighth switch element Q8, are connected to the third node n3. The eighth switch element Q8 is turned on during the address period (AD) in response to a control signal input to its gate terminal when it is necessary to lower a voltage of the scan electrode Y to the negative scan voltage (−Vy) using the scan pulse (−SCNP), thus lowering the voltage of the third node n3 to the negative scan voltage (−Vy).

A source terminal and the anode terminal of the body diode, of the ninth switch element Q9, are connected to the second node n2. A drain terminal and the cathode terminal of the body diode, of the ninth switch element Q9, are connected to the fourth node n4. The ninth switch element Q9 keeps turned off during the set-up period (SU) in response to a control signal input to its gate terminal, thus blocking a current path between the second node n2 and the fourth node n4, but is turned on when it is necessary to lower a voltage of the scan electrode Y to the ground voltage (GND) or the negative scan voltage (−Vy), thus supplying a voltage of the fourth node n4 to the second node n2.

A source terminal and the anode terminal of the body diode, of the tenth switch element Q10, are connected to the fourth node n4. A drain terminal and the cathode terminal of the body diode, of the tenth switch element Q10, are connected to the scan bias voltage source (Vscb). The tenth switch element Q10 is turned on during a scan time of the address period (AP) in response to a control signal input to its gate terminal, thus supplying the scan bias voltage (Vscb) to the fourth node n4.

The first diode D1 supplies a voltage of the second node n2 to the third node n3 when the voltage of the second node n2 is higher than a voltage of the third node n3 as high as its threshold voltage, but blocks a current path of a reverse direction where a current flows from the third node n3 to the second node n2.

The number of the switch elements used in the scan driving circuit according to the present invention as shown in FIG. 8 is one smaller than that used in the existing scan driving circuit.

Furthermore, in the scan driver according to the present invention, since the fifth switch element Q5 also plays the role of the seventh switch element Q7 disposed in the existing scan driver, a connection direction of the drain terminal and the source terminal of the fifth switch element Q5 is opposite to those of the existing scan driver. In addition, since the ninth switch element Q9 also plays the role of the sixth and seventh switch elements Q6, Q7 disposed in the existing scan driver, the source terminal of the eighth switch element Q9 is connected to the second node n2 unlike the existing scan driving circuit.

Figure 3:
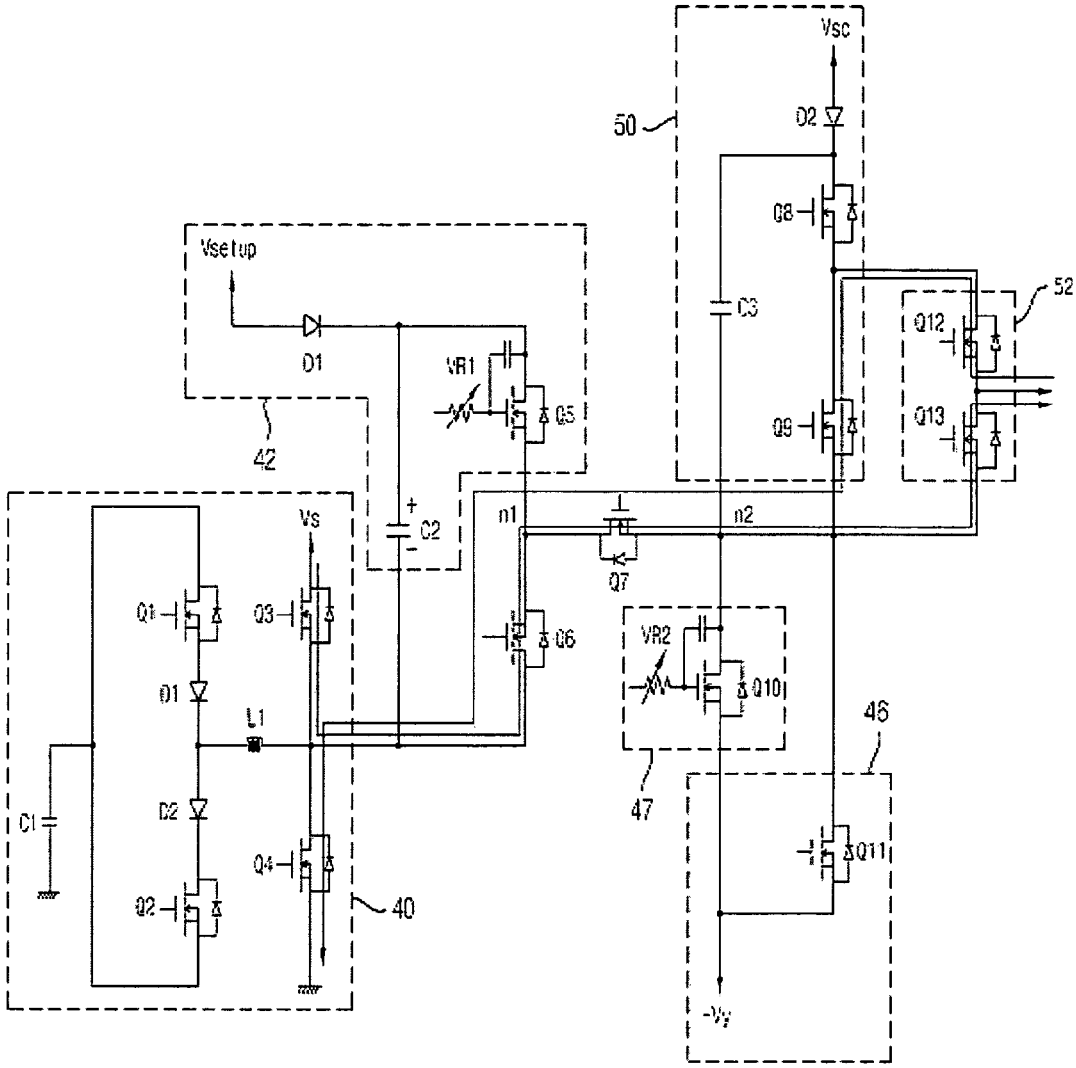
Fig. 3 Related Art
FIG. 3 is a schematic circuit diagram of a scan driving apparatus for driving the related art plasma display panel.
Figure 4:
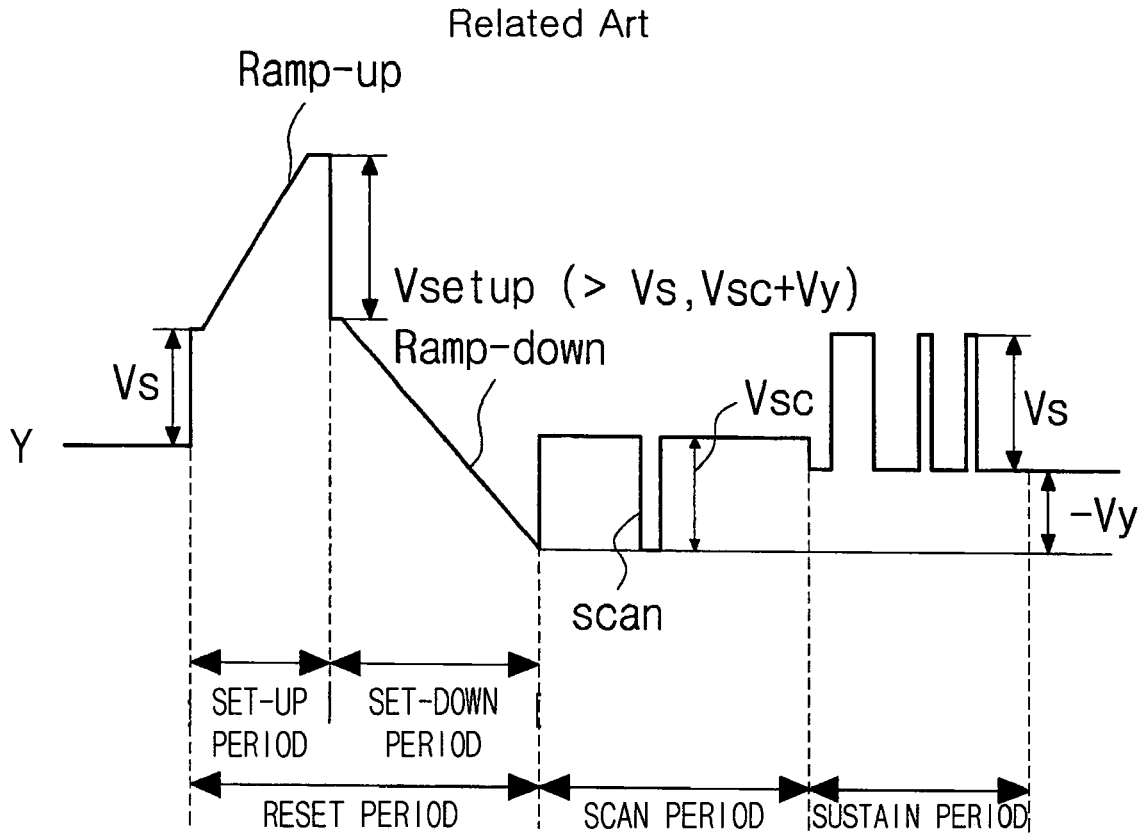
FIG. 4 shows a driving waveform illustrating a method of driving the scan driving apparatus of the related art plasma display panel shown in FIG. 3.

As described above, in the scan driver according to the present invention, the number of switch elements existing on a current path, more particularly, the number of FETs with high switching loss in comparison with a diode can be significantly reduced. For this reason, the scan driver according to the present invention is low in consumption power and generation of heat. For example, in FIG. 8, the third switch element Q3, the fifth switch element Q5, the diode D1, and the body diode of the twelfth switch element Q12 exist in a sustain-up current path 84 for maintaining a voltage of the scan electrode Y to the sustain voltage (Vs). Furthermore, in FIG. 8, the body diode of the eleventh switch element Q11, the ninth switch element Q9, the fifth switch element Q5 and the fourth switch element Q4 exist in a sustain-down current path 85 for maintaining a voltage of the scan electrode Y to the ground voltage (GND) or 0V. Accordingly, in the scan driver according to the present invention, the number of FETs existing in the sustain-up current path 84 and the sustain-down current path, respectively, can be reduced in comparison with the existing scan driver of FIG. 3.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus, comprising:

a plasma display panel comprising a scan electrode;

a set-up driver to apply a rising pulse to the scan electrode during a reset period of a sub-field;

a set-down driver to apply, during the sub-field, a first ramp-down pulse to the scan electrode before the rising pulse is applied to the scan electrode and for applying a second ramp-down pulse to the scan electrode after the rising pulse is applied to the scan electrode; and a scan pulse driver to apply a scan pulse, having a voltage with an amplitude which is at least substantially equal to or greater than a voltage of the rising pulse, to the scan electrode during an address period subsequent to the reset period.

2. The plasma display apparatus as claimed in claim 1, wherein a reference voltage from which the first ramp-down pulse begins is at least substantially equal to a reference voltage from which the second ramp-down pulse begins.

3. The plasma display apparatus as claimed in claim 1, wherein a reference voltage from which the first ramp-down pulse begins is at least substantially equal to a voltage of a sustain pulse applied to the scan electrode during a sustain period.

4. The plasma display apparatus as claimed in claim 1, wherein a gradient of the first ramp-down pulse is at least substantially equal to a gradient of the second ramp-down pulse.

5. The plasma display apparatus as claimed in claim 1, wherein the voltage of the rising pulse rises above a voltage value of a sustain pulse applied to the scan electrode during a sustain period.

6. The plasma display apparatus as claimed in claim 1, wherein a voltage of the second ramp-down pulse falls to or below a minimum voltage of a sustain pulse applied to the scan electrode during a sustain period.

7. The plasma display apparatus as claimed in claim 1, wherein a difference between a voltage of a starting point of the rising pulse and a voltage of an ending point of the rising pulse is less than a voltage of the scan pulse.

8. The plasma display apparatus as claimed in claim 1, wherein a difference between a voltage of a starting point of the rising pulse and a voltage of an ending point of the rising pulse equals 100V or less.

9. The plasma display apparatus as claimed in claim 1, wherein a voltage of an end point of the second ramp-down pulse is at least substantially equal to a minimum voltage of the scan pulse.

10. A plasma display apparatus comprising:

a plasma display panel comprising a scan electrode;

a set-up driver for applying a rising pulse to the scan electrode relative to a voltage supplied from a reference voltage source during a reset period of a sub-field, wherein the rising pulse is applied after a first ramp-down pulse is applied to the $_s$can electrode during the sub-field; and a scan pulse driver for applying a scan pulse to the scan electrode relative to the voltage supplied from the reference voltage source during an address period subsequent to the reset period, the scan pulse having a voltage with an amplitude which is at least substantially equal to or greater than a voltage of the rising pulse.

11. The plasma display apparatus as claimed in claim 10, wherein the rising pulse rises, with a gradient, from a voltage at least substantially equal to a peak voltage of a sustain pulse applied to the scan electrode during a sustain period.

12. The plasma display apparatus as claimed in claim 10, wherein a difference between a voltage at a starting point of the rising pulse and a voltage at an ending point of the rising pulse is 100V or less.

13. The plasma display apparatus as claimed in claim 10, wherein the set-up driver is adapted to apply a second ramp-down pulse to the scan electrode after the rising pulse is applied.

14. The plasma display apparatus as claimed in claim 13, wherein a gradient of the first ramp-down pulse is at least substantially equal to a gradient of the second ramp-down pulse.

15. The plasma display apparatus as claimed in claim 13, wherein a reference voltage from which the first ramp-down pulse begins is at least substantially equal to a peak voltage of a sustain pulse applied to the scan electrode during a sustain period.

16. The plasma display apparatus as claimed in claim 13, wherein a reference voltage from which the first ramp-down pulse begins is at least substantially equal to a reference voltage from which the second ramp-down pulse begins.

17. The plasma display apparatus as claimed in claim 13, wherein a lowest voltage of the second ramp-down pulse is at least substantially equal to a minimum voltage of the scan pulse applied to the scan electrode during the address period.

18. An apparatus for driving a plasma display panel, comprising:

a sustain pulse reference voltage node;

an energy recovery circuit connected to the sustain pulse reference voltage node;

a blocking switch connected at one end to an output terminal of the energy recovery circuit;

a scan pulse and set-up pulse reference voltage node directly connected to a voltage source for supplying a ramp-up signal and a scan pulse to a scan electrode;

a set-up capacitor having a first conductor directly connected to the scan pulse and set-up pulse reference voltage node and a second conductor directly connected to an other end of the blocking switch; and first and second set-up switches disposed in series between the scan pulse and set-up pulse reference voltage node and the other end of the blocking switch.

19. The plasma display apparatus as claimed in claim 1, wherein the first ramp-down pulse at least partially erases wall charges on one or more cells of the plasma display apparatus, to form at least a substantially uniform distribution of wall charges within said one or more cells.

20. The plasma display apparatus as claimed in claim 1, wherein a difference between a voltage of a starting point of the rising pulse and a voltage of an ending point of the rising pulse is at least substantially equal to or less than a voltage of the scan pulse.

21. The plasma display apparatus as claimed in claim 1, further comprising:

an energy recovery circuit; and a blocking circuit between the energy recovery circuit and each of the set-up driver, set-down driver, and scan pulse driver, wherein the blocking circuit closes a signal path between the energy recovery circuit and each of the set-up drier, set-down driver, and scan pulse driver based on application of a predetermined voltage to the scan electrode, and wherein the set-up driver applies the rising pulse to the scan electrode during the reset period along a signal path that does not pass through the blocking circuit.

22. The plasma display apparatus as claimed in claim 21, wherein the set-up driver and scan driver are coupled to a same voltage source, said voltage source providing a setup voltage that is at least substantially equal to or less than the voltage of the scan pulse.

23. The plasma display apparatus as claimed in claim 22, wherein the setup voltage corresponds to a difference between a voltage of a starting point of the rising pulse and a voltage of an ending point of the rising pulse is less than a voltage of the scan pulse.

24. The plasma display apparatus as claimed in claim 1, wherein:

the first ramp-down pulse falls from a first voltage to a second voltage at a first slope;

the rising pulse rises from a third voltage to a fourth voltage with a second slope;

the second ramp-down pulse falls from a fifth to a sixth voltage at a third slope;

the first voltage is at least substantially equal to the fifth voltage;

the second voltage is at least substantially equal to the sixth voltage;

the third voltage is at least substantially equal to the first and fifth voltages; and the first slope is substantially equal to the third slope.

25. The plasma display apparatus as claimed in claim 24, wherein the voltage of the scan electrode rises from the second voltage to a seventh voltage and then rises from the seventh voltage to the third voltage, and wherein a difference between the third voltage and seventh voltage is smaller than the voltage of the scan pulse applied to the scan electrode during the address period.

26. The plasma display apparatus as claimed in claim 25, wherein the difference between the third voltage and the seventh voltage is at least substantially equal to the first voltage.

27. The plasma display apparatus as claimed in claim 26, wherein a time delay exists between a time when the second voltage rises to the seventh voltage and a time when the seventh voltage rises to the third voltage.

28. The plasma display apparatus as claimed in claim 27, wherein the voltage of the scan electrode rises from the sixth voltage to an eighth voltage during the address period, the scan pulse applied during the address period falling from the eighth voltage to substantially the sixth voltage.

29. The plasma display apparatus as claimed in claim 28, wherein the voltage of the scan electrode falls from the eighth voltage to a ninth voltage during a sustain period, the ninth voltage being less than the first, third, fifth voltages and less than a difference between the fifth voltage and the fourth voltage.

30. The plasma display apparatus as claimed in claim 29, wherein the voltage of the scan electrode rises from the ninth voltage to a tenth voltage during the sustain period, the tenth voltage being greater than the eighth voltage.

* * * * *